US005850872A

United States Patent [19]

Cesaroni

[11] Patent Number: 5,850,872

[45] Date of Patent: Dec. 22, 1998

[54] COOLING SYSTEM FOR VEHICLES

[75] Inventor: Anthony Joseph Cesaroni, Unionville, Canada

[73] Assignee: E. I. du Pont de Nemours and Company, Wilmington, Del.

[21] Appl. No.: 753,456

[22] Filed: Nov. 25, 1996

Related U.S. Application Data

[60] Provisional application No. 60/008,579 Dec. 13, 1995.

[51] Int. Cl. [6] ..... F01P 7/10

[52] U.S. Cl. ..... 165/41; 165/125; 165/51; 165/122; 165/124; 165/905; 165/140

[58] Field of Search ..... 165/51, 125, 122, 165/124, 41, 905, 140

[56] References Cited

U.S. PATENT DOCUMENTS

| | | | |
|---|---|---|---|
| 914,822 | 3/1909 | Goudard et al. | 165/125 |
| 1,992,130 | 2/1935 | Rose | 165/125 |
| 2,153,120 | 4/1939 | Ludlow et al. | 165/125 |
| 2,238,585 | 4/1941 | Findley | 165/125 |
| 2,277,247 | 3/1942 | Morse | 165/125 |
| 2,486,145 | 10/1949 | Frie | 165/125 |
| 2,600,933 | 6/1952 | Spieth | 257/137 |
| 2,662,748 | 12/1953 | Huber | 165/125 |
| 3,401,743 | 9/1968 | Francis | 165/51 |
| 3,692,004 | 9/1972 | Tangue et al. | 165/122 |
| 3,800,866 | 4/1974 | Ireland et al. | 165/51 |
| 4,210,835 | 7/1980 | Neveux | 165/122 |
| 4,358,245 | 11/1982 | Gray | 165/51 |
| 4,876,492 | 10/1989 | Lester et al. | 310/63 |
| 4,962,734 | 10/1990 | Jorgensen | 165/51 |
| 5,079,488 | 1/1992 | Harms et al. | 123/41.02 |
| 5,334,898 | 8/1994 | Skybyk | 310/268 |

*Primary Examiner*—John K. Ford

[57] ABSTRACT

A cooling system for a vehicle. The cooling system has a radiator and a fan that draws cooling air through the radiator. The fan is recessed into the radiator such that the motor is substantially cooled by air that has not passed through said radiator. The radiator may be an interconnected spaced-apart bi-sectional radiator with the fan interposed therebetween, the radiator being shaped so as to feed air through the fan. The cooling system may have a variable speed pump at the outlet to the radiator.

3 Claims, 3 Drawing Sheets

COOLING SYSTEM FOR VEHICLES

This application claims benefit of provisional application Ser. No. 60/008,579 filed Dec. 13, 1995.

FIELD OF THE INVENTION

The present invention provides a cooling system for a vehicle, especially an automobile. The cooling system has a radiator and a fan, with the fan being recessed into the radiator. Panels on the radiator are shaped such that air passes through the radiator and is directed towards and through the fan. The fan has the motor located towards the leading edge, such that air passing through the radiator is not used in the cooling of the fan.

BACKGROUND TO THE INVENTION

Motors on a vehicle require cooling while the motor is operating, to withdraw heat resulting from combustion of fuel. This is normally done using a radiator located in the front of the vehicle and disposed transverse to the direction of movement of the vehicle. A fan is located behind the radiator to draw air through the radiator so that cooling may be effected when the vehicle is stationary and to more effectively draw air through the radiator when the vehicle is moving. The fan may be separate from the radiator, but in many modem vehicles it is frequently attached to the rear (trailing side) of the radiator, to form a cooling system, with a shroud surrounding the blades of the fan. For vehicles equipped with air conditioning systems, the part of the air conditioner that requires cooling is also generally located close to the radiator, and frequently directly in front of the radiator, to utilize the beneficial effects of the fan.

Panel heat exchangers formed from thermoplastic polymers, and methods for the manufacture of such heat exchangers, are known. For instance, a number of heat exchangers formed from thermoplastic polymers, especially aliphatic polyamides, are disclosed in PCT patent application WO 91/02209 of A. J. Cesaroni, published Feb. 21, 1991, and in the published patent applications referred to therein. Such heat exchangers offer the benefit of reduced weight, compared to traditional metal heat exchangers, while exhibiting efficiencies similar to those of metal heat exchangers.

While the designs of radiators for vehicles have undergone a number of improvements in recent years, especially to make the radiator and associated fan more compact while retaining the efficiency of the heat exchanger, additional improvements in the development of cooling systems for vehicles would be beneficial especially so that the radiator and associated fan would occupy even less space than currently utilized in vehicles.

SUMMARY OF THE INVENTION

A compact cooling system for a vehicle has now been found, in which the fan is recessed into the radiator and the shroud may be eliminated.

An aspect of the present invention provides a cooling system for a vehicle, said cooling system having a radiator and a fan, especially a fan with a brushless DC motor, said fan drawing cooling air through said radiator, said fan being recessed into said radiator such that said motor is substantially cooled by air that has not passed through said radiator.

In a preferred embodiment of the invention, the fan is located between sections of the radiator and does not extend outwardly therefrom.

In a further embodiment, the fan motor is located in the hub to which the blades of the fan are attached, preferably with said blades located over said hub.

In another preferred embodiment of the invention, the radiator is a double-pass radiator, preferably with the air passing through the radiator such that there is a maximum temperature differential between said air and fluid within the radiator.

In another aspect of the present invention there is provided a cooling system for a vehicle having a radiator and a fan, said radiator being an interconnected spaced-apart bi-sectional radiator with said fan interposed therebetween, said radiator being shaped so as to feed air through said fan.

Another aspect of the present invention provides a cooling system for a vehicle having a radiator and a fan, preferably a fan with a brushless DC motor, said fan drawing cooling air through said radiator, said fan being recessed into said radiator such that said motor is substantially cooled by air that is not passed through said radiator, said cooling system having a variable speed pump at the outlet to said radiator.

In an embodiment of the cooling system of the invention, the variable speed pump replaces the thermostat for the cooling system.

In another embodiment of the present invention, the fan has an overflow tank located on the shroud of the fan, especially located between said fan and said radiator.

BRIEF DESCRIPTION OF THE DRAWINGS

The present invention is illustrated by the embodiments shown in the drawings, in which.

DETAILED DESCRIPTION OF THE INVENTION

Figure 1:
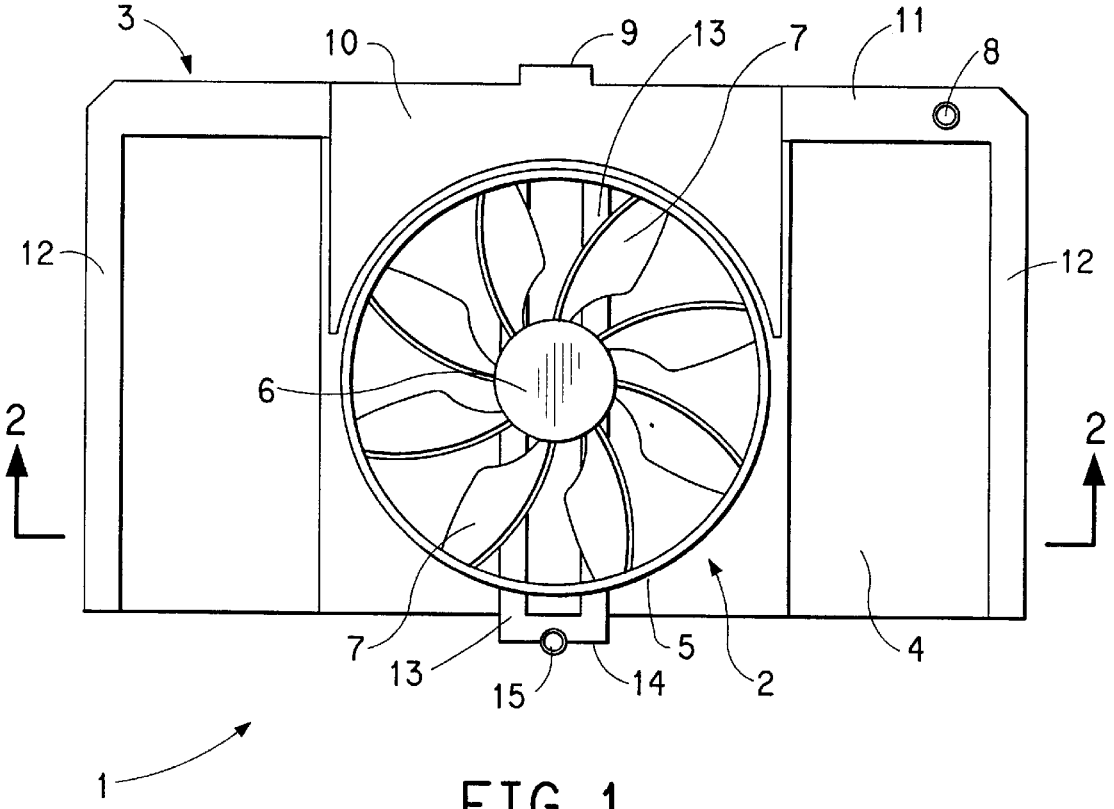
FIG. 1 is a schematic representation of a cooling system of the invention viewed from the rear.

FIG. 1 shows a cooling system generally indicated by 1, having a fan generally indicated by 2, and radiator 3. Fan 2 has a housing 5 in which motor 6 is axially located. Motor 6 has a plurality of fan blades 7. As shown in FIG. 1, motor 6 is centrally located within cooling system 1, but it is to be understood that it could be offset from the center thereof. Fan 2 does not have a shroud located thereon, for protective purposes and for directing air passing through the radiator, but utilizes the shape of the panels of the radiator, as discussed herein, to direct air to the blades of the fan.

Fan 2, with its associated motor, blades and hub, needs to be compact. Thus, a preferred fan has its motor located within the hub of the fan, with the blades attached to the outside of the hub, preferably in a swept-back position such that the blades are located in the same plane as the hub. Such a fan is compact. A variety of types of motors or methods of driving the fan may be used in the fan, of which a brushless DC motor is preferred because of its compact nature.

Radiator 3 has inlet 8 located in manifold header 11. Manifold header 11 also has a centrally located radiator cap 9. Manifold header 11 extends across the top of radiator 3, and then extends downward on each of its opposite sides forming end manifold headers 12. End manifold headers 12 are connected to radiator panels 4, and act as the inlets for radiator panels 4. The outlet for radiator panels 4 is at central manifold headers 13. The embodiment shown has two central manifold headers 13. Such headers extend down to outlet manifold header 14, and terminate in outlet 15. Overflow container 10 is shown as centrally located in the upper portion of cooling system 1, above fan housing 5, and would be connected to radiator 3 by means not shown. Thus, FIG. 1 shows a bi-sectional radiator as more clearly seen elsewhere.

Figure 2:
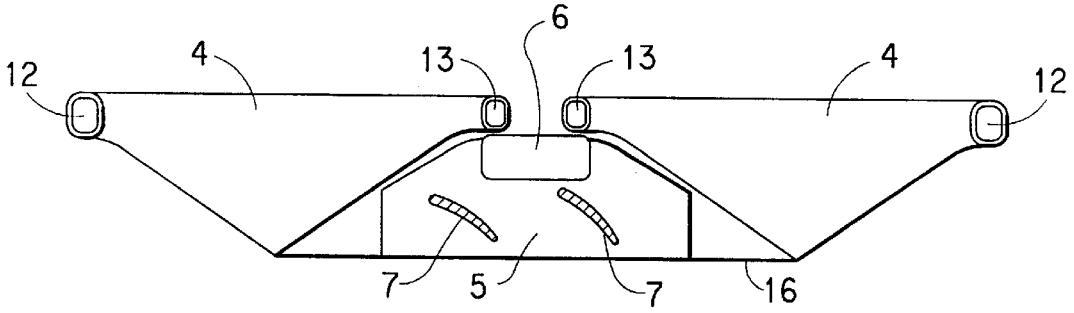
FIG. 2 is a schematic representation of a cross-section of the cooling system through B—B of FIG. 1.

FIG. 2 shows the cross-section of FIG. 1 through B—B. Fan housing 5 is centrally located and encloses fan blades 7. Radiator panels 4 are shown in two separate locations on opposite sides of fan housing 5, in each instance extending between end manifold header 12 and central manifold header 13.

Figure 3:
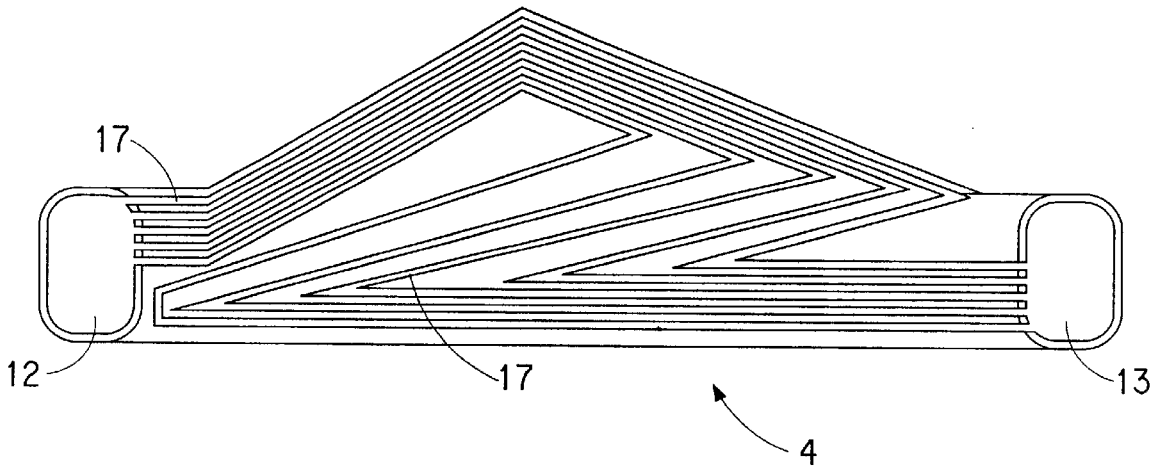
FIG. 3 is a schematic representation of a radiator panel.

FIG. 3 shows a cross-section of a radiator panel 4 in more detail. Radiator panel 4 extends from end manifold header 12 to central manifold header 13. A plurality of channels 17 are shown extending from end manifold header 12 in a pattern that provides fluid-flow passage from end manifold header 12 to a location juxtaposed to central manifold header 13, returning to a location juxtaposed to end manifold header 12 and then returning once again to exit at central manifold header 13. Such a pattern may be referred to as a "dual pass." As discussed herein, a variety of such patterns may be used.

FIG. 3 shows radiator panel 4 with five channels extending from end manifold header 12 to central manifold header 13. It is understood that in practice a radiator would have substantially more than five channels extending between such headers. It is also to be understood that radiator panel 4 would have a pattern of channels 17 utilizing the full extent of the surface of radiator panel 4 so as to achieve a high degree of transfer of heat. Radiator panel 4 has been shown with only five channels in the pattern of FIG. 3 for clarity only.

Figure 4:
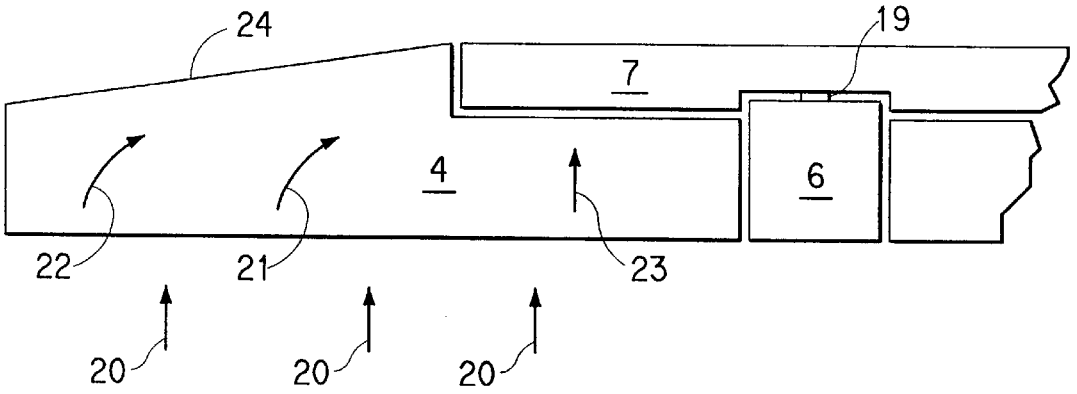
FIG. 4 is a schematic representation of a portion of the cooling system showing air flow through the system.

FIG. 4 is a schematic representation of a cross-section of radiator panel 4 with motor 6 and fan blades 7 showing flow of air through the cooling system. Fan blades 7 are shown as attached to motor 6 by shaft 19. Air entering the radiator is shown by arrows 20. Air 20 enters radiator panel 4 at front edge 21 and either flows in a curved pattern as indicated by arrows 22 or in a straight-through manner as indicated by arrow 23. The flow pattern of air 20 through radiator panel 4 is achieved by having trailing edge 24 of radiator panel 4 provide complete or partial blockage (restriction) of passage of air passed such edge, as discussed below. Thus, trailing edge 24 restricts air 20 from passing straight through panels 4 and redirects it towards fan blades 7. The rotation of fan blades 7 also serves to draw air in the same direction. It will be noted that motor 6 is in contact with air 20 which is cooling air, rather than air following the path of arrows 22 and 23, which is air heated by panel 4. Such air 20 provides all or a substantial portion of the air for cooling of motor 6.

Figure 5:
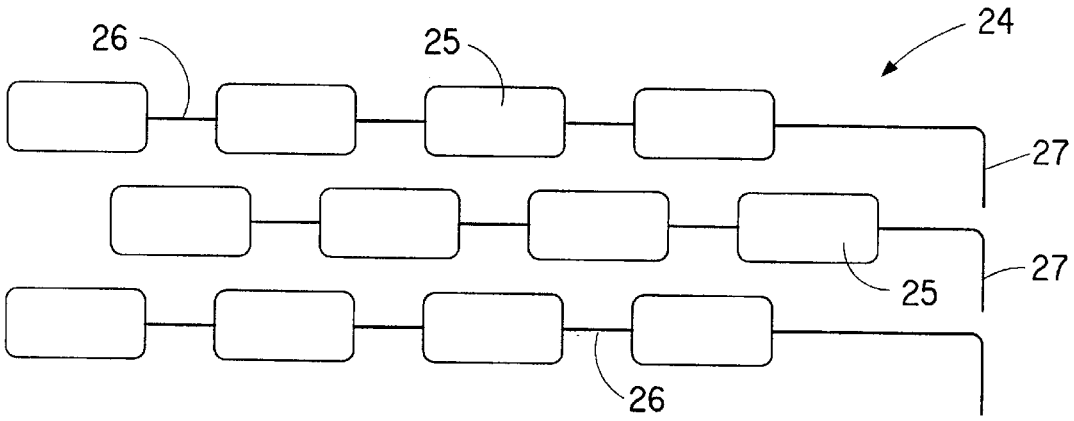
FIG. 5 is a cross-section of a plurality of panels showing airflow restrictions at the trailing edge.
Figure 6:
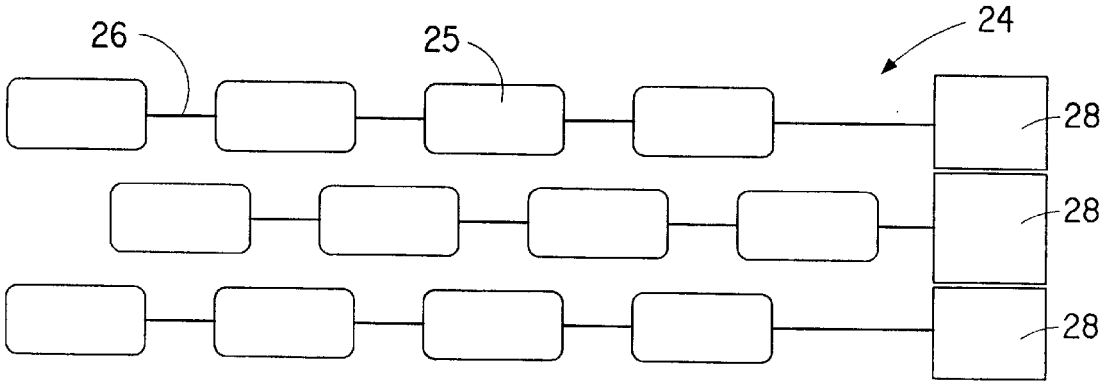
FIG. 6 is an alternate embodiment showing substantially complete air-flow blockage at the trailing edge.

Methods for achieving complete or partial restriction of air at trailing edge 24 are shown in FIG. 5 and FIG. 6.

FIG. 5 shows a cross-section of a plurality of fluid channels 25, corresponding to channels 17, that would extend from end manifold header 12 to central manifold header 13. Fluid flow channels 25 are held in position by panel sheet 26. In the embodiment of FIG. 5, panel sheet 26 at trailing edge 24 thereof is curved downwards to form the trailing edge, forming barrier 27 in doing so. FIG. 5 as illustrated would be a form of a panel having a trailing edge 24 that exhibits partial blockage of the flow of air through radiator panel 4.

In the embodiment of FIG. 6, a plurality of fluid flow channels 25 held in position by panel sheet 26 are shown. However, in the embodiment of FIG. 6, each panel sheet 26 terminates in large channel 28 and moreover, large channels 28 are shown in contact with each other, forming a barrier along trailing edge 24 of the panel. However it is to be understood that gaps could be provided between large channels 28 so that air could bleed between the panels, i.e., through trailing edge 24.

As disclosed herein, the radiator is in the form of a plurality of panels arranged in a parallel spaced-apart relationship. Such panels are known. The edges of the panels are disposed towards the source of the cooling air such that the air flows over the panels with minimal restriction. In preferred embodiments, the panels are comprised of a plurality of channels formed in the sheet that forms the panels. Alternatively the channels may be in the form of tubes which are located between sheets in a parallel aligned relationship to form the panel. It is to be understood, however, that a variety of designs of panels may be used in the cooling system of the present invention.

In preferred embodiments, the cooling system, especially the panels and manifolds may be formed from a variety of polyamide compositions. The composition selected will depend primarily on the end use, especially the temperature of use and the environment of use of such a heat exchanger, including the fluid that will be passed through the heat exchanger and the fluid e.g., air, external to the heat exchanger. Such air may be air that at times contains salt or other corrosive or abrasive matter, or the fluid may be liquid e.g., radiator fluid.

A preferred polymer of construction is polyamide. Examples of polyamides are the polyamides formed by the condensation polymerization of an aliphatic dicarboxylic acid having 6–12 carbon atoms with an aliphatic primary diamine having 6–12 carbon atoms. Alternatively, the polyamide may be formed by condensation polymerization of an aliphatic lactam or alpha, omega aminocarboxylic acid having 6–12 carbon atoms. In addition, the polyamide may be formed by copolymerization of mixtures of such dicarboxylic acids, diamines, lactams and aminocarboxylic acids. Examples of dicarboxylic acids are 1,6-hexanedioic acid (adipic acid), 1,7-heptanedioic acid (pimelic acid), 1,8-octanedioic acid (suberic acid), 1,9-nonanedioic acid (azelaic acid), 1,10-decanedioic acid (sebacic acid) and 1,12-dodecanedioic acid. Examples of diamines are 1,6-hexamethylene diamine, 1,8-octamethylene diamine, 1,10-decamethylene diamine and 1,12-dodecamethylene diamine. An example of a lactam is caprolactam. Examples of alpha, omega aminocarboxylic acids are amino octanoic acid, amino decanoic acid, amino undecanoic acid and amino dodecanoic acid. Preferred examples of the polyamides are polyhexamethylene adipamide and polycaprolactam, which are also known as nylon 66 and nylon 6, respectively.

While particular reference has been made herein to the use of polyamides as the polymer used in the fabrication of all or part of the cooling system, it is to be understood that other polymers may be used. Examples of other thermoplastic polymers that may be used are polyethyiene, polypropylene, fluorocarbon polymers, polyesters, elastomers e.g., polyetherester elastomers, neoprene, chlorosulphonated polyethylene, and ethylene/propylene/diene (EPDM) elastomers, polyvinyl chloride and polyurethane.

In preferred embodiments of the present invention, the channels are formed from tubing that has a thickness of less than 0.7 mm, and especially in the range of 0.07–0.50 mm, particularly 0.12–0.30 mm. The thickness of the tubing will, however, depend to a significant extent on the proposed end use and especially the properties required for that end use.

The polymer compositions used in the fabrication of the heat exchangers may contain stabilizers, pigments, fillers, including glass fibres, and the like, as will be appreciated by those skilled in the art.

All seals should be fluid tight seals, to prevent leakage of fluid from the heat exchanger.

An overflow tank, which may also be referred to as a coolant recovery tank, may be located within the cooling system. Such an overflow tank forms part of many vehicles and is attached to the radiator thereof for retention of excess fluid or for replenishment of fluid into the radiator, as is known. In the cooling system of the invention, the overflow tank is conveniently located on the exterior of the fan, forming part of the housing of the fan. A suitable connection is then provided from the overflow tank to the manifold to the radiator.

The outlet to the manifolds of the cooling system may be connected to a pump. For instance, central manifold headers 13 shown in FIG. 1 could be connected to opposite sides of an impeller of a pump, such pump having a motor attached thereto. The pump could be a variable speed pump, operating at a speed appropriate to the requirements imposed on the cooling system. For instance, the pump could remain operational after the engine of the vehicle has been turned off, to prevent so-called "after-boil" in the engine or a part of the cooling system. It is understood that such a pump could operate independent of a thermostat or replace the thermostat conventionally used in a cooling system. Thus, for example, the pump could eliminate the need for a thermostat within the cooling system, with the pump being operated to maintain a required temperature within the cooling system.

As disclosed herein, the motor of the fan is primarily cooled using air that has not passed through the heat exchange portion of the cooling system. Thus, the motor of the fan is maintained at a significantly lower temperature than would be the case if air passing through the radiator was passed over the motor for purpose of cooling the motor. This should result in a longer lifespan for the motor of the fan.

It is also understood that the shroud normally associated with the fan and motor of the cooling system may be eliminated in the cooling system of the invention. In particular the shroud is replaced by portions of the construction of the cooling system, especially those parts utilized in maintaining the integrity of the cooling system e.g. braces and the like.

The individual panels of the radiator have been illustrated herein as being in the shape of a triangle combined with a rectangle. It has been further illustrated herein that the combination of the radiator and the fan form the shape of a truncated triangle on a rectangle. Such shapes are preferred and result in a compact cooling system. However, it is to be understood that some variation in the shape of the cooling system is permitted, within the requirements to maintain a compact cooling system and to have the cooling fan located between sections of the bi-sectional radiator.

The cooling system of the present invention provides a radiator with associated fan in a compact, substantially cuboid arrangement, with relatively narrow depth. The cooling system can reduce the thickness of the radiator and associated fan of the cooling system of a typical mid-sized automobile by one or more inches, while providing an equivalent cooling capacity for the engine of the automobile, thus allowing further design flexibility for automotive engineers. The "under the hood" area of an automobile has a large number of components arranged in the area, with little spare space. Thus, being able to accommodate the cooling system in a smaller space has significant advantages to the automotive design engineers, to permit further equipment to be placed in the "under the hood" area, to allow flexibility in the shape and area required for the front end of the vehicle or the like.

I claim:

1. A cooling system for a vehicle, said cooling system having a radiator, a fan, and a motor said fan drawing cooling air through said radiator, said fan being recessed into said radiator such that said motor is substantially cooled by air that has not passed through said radiator;

characterized in that said radiator is an interconnected spaced-apart bi-sectional radiator having two sections with said fan interposed between the two sections, said two sections being on axially opposed sides of the fan, said radiator being shaped so as to feed air through said fan, said fan being located between sections of the radiator and not extending outwardly therefrom, each of the two sections of the radiator having at least three faces, a first face of the section being essentially perpendicular to the direction of air flow into the section, a second face being at an angle back from said first face less than a right angle, and a third face at an angle to said second face, said first face, second and third faces, along with any additional faces, forming a closed shape which is generally triangular, so that the radiator and associated fan occupy less space than would be required if the radiator section were rectangular in shape to obtain equivalent heat transfer with the same area of the two first faces, but leaving an opening between the two first faces for the fan with each section of the radiator having a multiplicity of connected fluid channels for heat exchange which parallel each of the first, second, and third faces.

2. The cooling system of claim 1 in which said channels are connected from the third face to the first by channels crossing the interior of the sections, and said channels opening into headers at the end of the second face where it abuts the first face and at the end of the first face where it abuts the third face.

3. The cooling system of claim 1 with said fan being recessed into said radiator such that said motor is substantially cooled by air that is not passed through said radiator.

* * * * *